United States Patent [19]

Akanuma et al.

[11] Patent Number: 4,804,932

[45] Date of Patent: Feb. 14, 1989

[54] MERCURY WETTED CONTACT SWITCH

[75] Inventors: Teruhiko Akanuma, Tokyo; Masaharu Enomoto, Hyogo, both of Japan

[73] Assignee: NEC Corporation, Japan

[21] Appl. No.: 87,660

[22] Filed: Aug. 20, 1987

[30] Foreign Application Priority Data

Aug. 22, 1986 [JP] Japan ..... 61-197601
Aug. 29, 1986 [JP] Japan ..... 61-204934

[51] Int. Cl.[4] ..... H01H 1/08; H01H 29/00

[52] U.S. Cl. ..... 335/58; 335/47; 335/51

[58] Field of Search ..... 335/151, 152, 153, 154, 335/58, 47, 49, 50, 51, 54

[56] References Cited

U.S. PATENT DOCUMENTS 2,302,546 11/1942 Harrison ..... 335/58
2,837,612 6/1958 Gustafson et al. ..... 335/58
2,914,634 11/1959 Koda ..... 335/58

*Primary Examiner*—E. A. Goldberg
*Assistant Examiner*—Lincoln Donovan
*Attorney, Agent, or Firm*—Laff, Whitesel, Conte & Saret

[57] ABSTRACT

A glass reed relay has an elongated glass enclosure with an electrode passing through and being sealed to each of the opposite ends of said enclosure. One of the electrodes has an associated reed for making and breaking contact with the other of said electrodes. The other electrode has a hollow tubular structure filled with mercury. The dimensions are such that only a limited amount of mercury can escape therefrom in order to wet the contacts without creating a pool of mercury.

2 Claims, 4 Drawing Sheets

MERCURY WETTED CONTACT SWITCH

BACKGROUND OF THE INVENTION

1. Field of the Invention

The present invention relates to a mercury wetted contact switch (hereinafter referred to simply as "mercury switch") and, more particularly, to a position-insensitive murcury switch.

2. Description of the Prior Art

In mercury swtich whose contact resistance is stabilized, chattering is prevented. The useful life of the switch is extended by forming a lasting film of conductive fluid (mercury) on the contacting part of each of the movable contact member and the fixed contact member, both of which are sealed in a container. This type of switch is used in various fields of many industry. If a switch has a large quantity of mercury sealed in its housing, to be supplied to the contacting parts, it is prevented from the normal operation by the movements of the pool of mercury unless its attitude of use is properly restricted. As a result, the switch tends to have limited applications. For this reason, a position-insensitive mercury switch is one for enabling a normal operation in any attitude, by appropriately limiting the quantity of mercury thereof.

A position-insensitive mercury switch, known in the prior art will be described below with reference to FIG. 1. A fixed side electrode 11 is positioned at one end of a sealed housing 13. An armature 12*a* of a movable side electrode 12 is positioned at the other end of the housing 13, these two electrodes being opposite each other in this housing 13. The armature 12*a* is connected to a stem 12*c* by way of a hinge spring 12*b*. The surface of the stem 12*c* within the housing 13, the armature 12*a*, the spring 12*b* and a fixed electric contact 11*b* positioned on a magnetic pole section 11*a* of the electrode 11 are all wetted with mercury. Meanwhile, the pole section 11*a* is treated so that it is not wetted with the mercury. The quantity of the mercury is controlled in advance so that the fixed contact 11*b* and the armature 12*a* are not short-circuited by the mercury, in any attitude of the mercury switch. Thus, there is no mercury pool which is present in a mercury switch whose attitude of use is specifically restricted.

In response to the impression of a magnetic field from outside bulb 13, a magnetic attractive force is generated between the electrode 11 and the armature 12*a*, each consisting of a magnetic substance. A result is that the flexibility of the spring 12*b* inclines the armature 12*a* to bring it into contact with the contact 11*b*, and between the fixed side electrode 11 and the movable side of electrode 12 which are thereby electrically connected to each other.

When the external magnetic field is removed, the armature 12*a* is restored to its usual position by the retractive force of the spring 12*b*. The electrodes 11 and 12 are then electrically isolated from each other.

Since the armature 12*a* and the contact 11*b* are wetted with the mercury, the contact between the contact 11*b* and the armature 12*a* is stabilized. Even if a spark occurs between them, the contact 11*b* and the armature 12*a* will be protected and their service lives will be prolonged. A method to manufacture such a position-insensitive mercury switch using a limited quantity of mercury is disclosed in the U.S. Pat. No. 3,116,384.

In such a mercury switch, however, the impact the armature 12*a* suffers from its collision with the contact 11*b* when the switch is turned on. The centrifugal force generated by the vibration of the armature 12*a*, when it is turned off, cause the mercury on the armature 12*a* to splash and adhere to the inner wall of the sealed housing 13. As a consequence, a problem arises, since the quantity of the mercury in the position-insensitive mercury switch, as described above, is limited to be no more than sufficient to wet the surface of the armature 12*a*. The contact face will become exposed after a repeated splashing of the mercury, to invite a considerable shortening of the useful life of the contact.

SUMMARY OF THE INVENTION

An object of the present invention is therefore, to eliminate the above-mentioned disadvantage of the mercury switch by the prior art and to provide a long-life position-insensitive mercury switch.

A mercury switch according to the invention is composed of:

- a sealed housing;
- mercury sealed into said housing;
- a fixed side electrode hermetically fitted to one end of said housing and having a flat magnetic pole section formed within said housing to enable its wettability with said mercury;
- a movable side electrode hermetically fitted to the other end of said housing;
- an armature which is unwettable with said mercury and positioned at one end of said movable side electrode to swing so as to approach or separate from said magnetic pole section; and
- a movable contact which is wettable with said mercury and fastened to said armature for coming into contact with or breaking away from said magnetic pole section.

BRIEF DESCRIPTION OF THE DRAWINGS

The above-mentioned object, feature and advantage of the present invention will be made more apparent from the detailed description hereunder when taken into conjunction with the accompanying drawings in which.

In these drawings, the same reference numerals represent the same structural elements, respectively.

DETAILED DESCRIPTION OF THE PREFERRED EMBODIMENT

Figure 2:
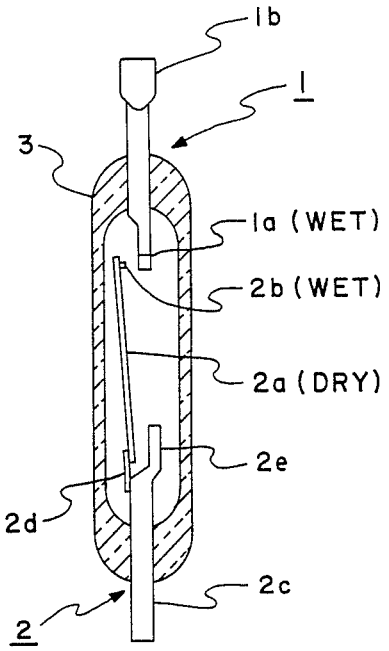
FIG. 2 is a vertical section view of an embodiment of the ivention.

Referring to FIG. 2, a preferred embodiment of the present invention comprises a sealed housing 3 made of a glass tube, a fixed side electrode 1 and a movable side electrode 2, both of which are hermetically fitted to one or the other end of the housing 3, and mercury (not shown) which is a conductive liquid sealed inside the housing 3.

The electrode 1 has a fixed side terminal section 1*b* for proving an external connection and a flat magnetic pole section 1*a* sealed into the housing 3.

Figure 3A:
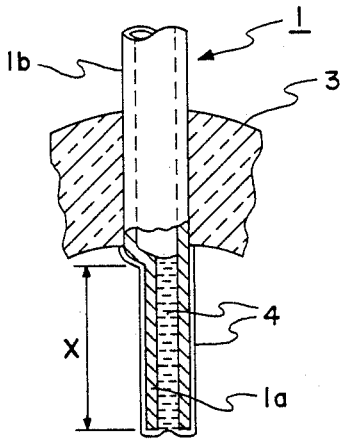
FIGS. 3A to 3C are a partial side section view, a front view and a end view showing a detail of the fixed side electrode shown in FIG. 2, respectively.
Figure 3B:
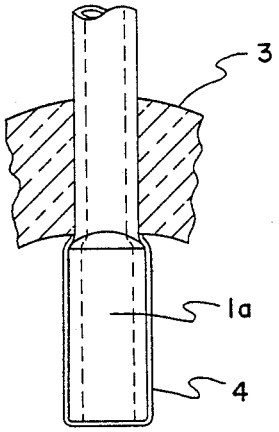
Figure 3C:
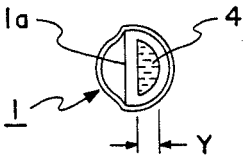

The pole section 1*a* plays the role of a fixed electrical contact of the mercury switch. In the fixed side electrode 1, as shown in FIGS. 3A to 3C, the lower end of a cylinder of magnetic substance (Fe-Ni alloy), open at both ends, is flattened so as not to block the opening and is appropriately machined to form the magnetic pole section 1*a*. Whereas the Fe-Ni alloy is wettable with the mercury, the external face of the part of the electrode 1 sealed into the housing 3 and the internal face of the cylinder are plated with nickel to further increase their wettability. After the fixed side electrode 1, formed in this manner, is hermetically fitted to one end of the housing 3, reductive gas ($H_2$ gas, for instance) or inert gas ($He_2$ gas) and the mercury are sealed into the housing 3 from an upper opening (not shown) through the inside of the cylinder. After that, the upper opening (not shown) of the electrode 1 is sealed by electrical welding to keep the inside of the housing 3 airtight.

Inside the hollow cylinder of the electrode 1, the mercury 4 is held by its surface tension.

The movable side electrode 2 has an armature 2*a* consisting of a flat piece of magnetic substance (Fe-Ni alloy), a stem 2*c* consisting of a rod of magnetic substance (Fe-Ni alloy) and serving as a terminal for external connection, and a conductive leaf spring 2*d* for connecting the armature 2*a* and the stem 2*c*. At the upper end of the stem 2*c* is formed a yoke 2*e* to facilitate the flow of the magnetic flux. A movable contact 2*b* of non-magnetic substance (Pt-Ni alloy) is fastened to the armature 2*a*. The entire surface of the armature 2*a*, except this contact 2*b*, is made unwettable with mercury by forming a Cr or W plating layer. The gap between the face of the armature 2*a* and the inner face of the housing 3 is smaller than the contact gap between the contact 2*b* and the pole section 1*a*. Therefore, when the contact 2*b* and the pole section 1*a* are separated, the armature 2*a* comes into contact with the housing 3 so that the vibration or bounce of the armature 2*a* can be prevented from a contact-remaking phenomenon.

The use of the non-magnetic material for the contact 2*b* is to facilitate the separation between the pole section 1*a* and the armature 2*a*, both consisting of a magnetic substance. The Pt-Ni alloy used for the contact 2*b* is wettable with the mercury.

The quantity of the mercury maintained in the electrode 1 is adjusted so as not to change the thickness of the mercury film on the surface of the pole section 1*a*, irrespective of the direction in which this switch is arranged, and to ensure an opening of the electric circuit, without giving rise to bridging, when the contact is broken.

The pole section 1*a* measures about 2.5 mm in length (X) and about 0.25 mm in the width of opening (Y), and about 1.5 mg of the mercury is retained in its hollow part 4.

In the mercury switch structured as described above, because a mercury supply to the contact faces is achieved from the fixed side electrode 1, there is no mercury exhaustion due to the vibration of the armature 2*a*, and the contact faces are prevented from exposure. Further, even if a minute amount of mercury is splashed by the impact of the contact 2*b* coming into contact with pole section 1*a*, the mercury contained in the electrode 1 will be supplied from the opening of the cylinder to the pole section 1*a*, so that the contact faces can remain useful for a longer period.

Figure 1:
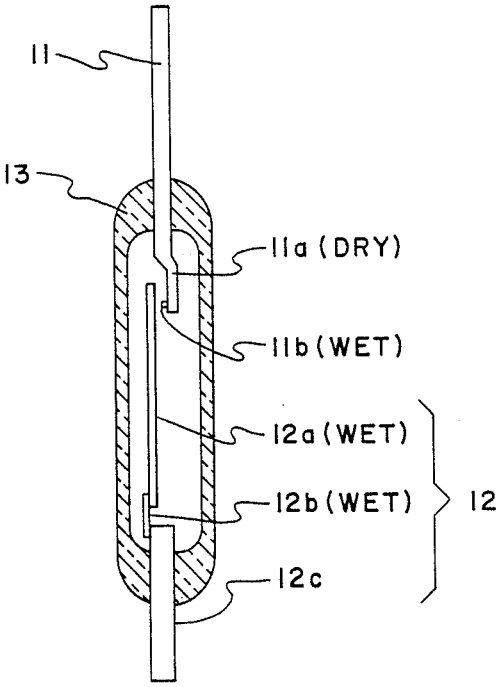
FIG. 1 (PRIOR ART)
FIG. 1 is a vertical section view of a prior art position-insensitive mercury switch.

Contrast the mercury switch of the conventional structure shown in FIG. 1, whose average useful life in terms of the number of operations is less than 10 million until the mercury film disappears and invites trouble, such as a sticking phenomenon. The inventive switch illustrated in FIG. 2 can withstand about 100 million such operations.

Figure 4A:
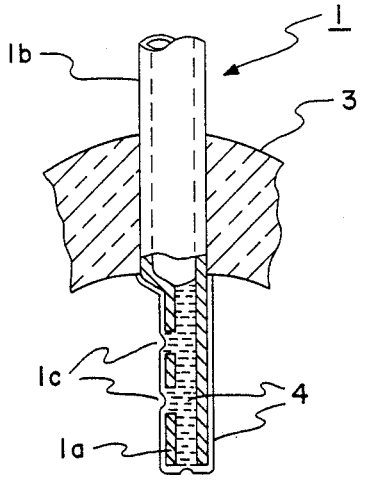
FIGS. 4A and 4B are a partial side section view and a front view showing a modification of the fixed side electrode shown in FIG. 2, respectively.
Figure 4B:
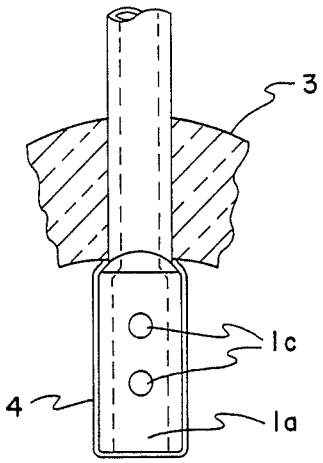

Referring now to FIGS. 4A and 4B, in a modification of the fixed side electrode 1, two holes 1*c* are formed in the pole section 1*a*. These holes 1*c* ensure a smooth supply of the mercury from inside the cylinder to the contacting faces. Only one such hole 1*c* could suffice.

Figure 5A:
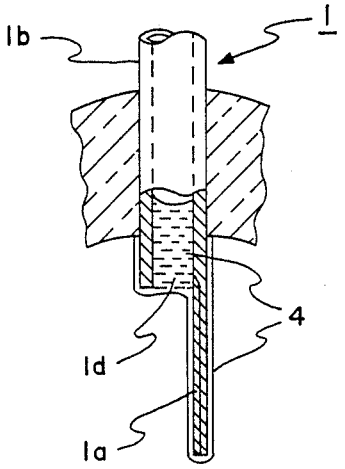
FIGS. 5A to 5C are a partial side section view, a front view and a bottom view showing another modification of the fixed side electrode shown in FIG. 2, respectively.
Figure 5B:
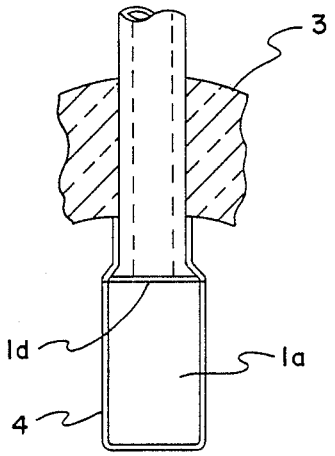
Figure 5C:
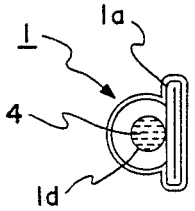

With reference to FIGS. 5A to 5C, in another modification of the electrode 1, the pole section 1*a* is formed by flattening the lower end section while forming an opening 1*d* by cutting the intermediate section of the cylinder of magnetic substance with a sharp edge. The mercury 4 maintained within the electrode 1 is supplied from the opening 1*d* to the pole section 1*a*.

Next, various shapes of the movable contact will be described with reference to FIGS. 6A to 6E.

Figure 6A:
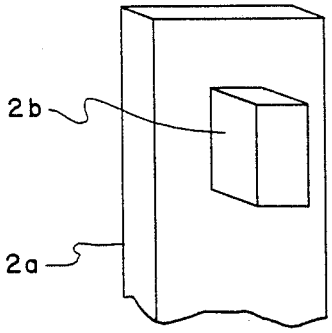
FIGS. 6A to 6E are perspective views showing various shapes of the movable contact shown in FIG. 2.
Figure 6B:
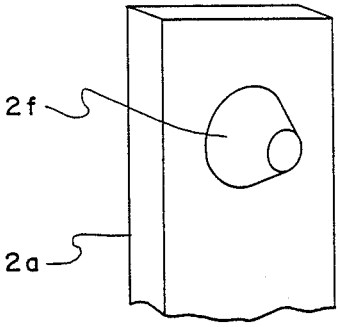
Figure 6C:
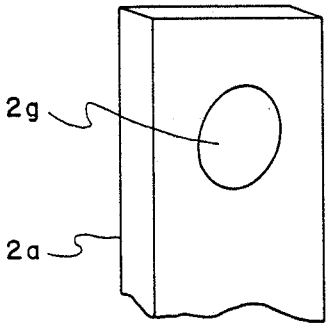
Figure 6D:
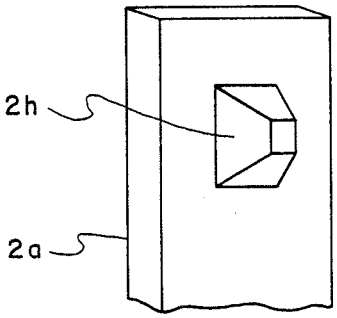
Figure 6E:
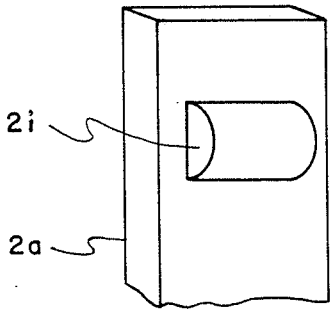
Figure 7A:
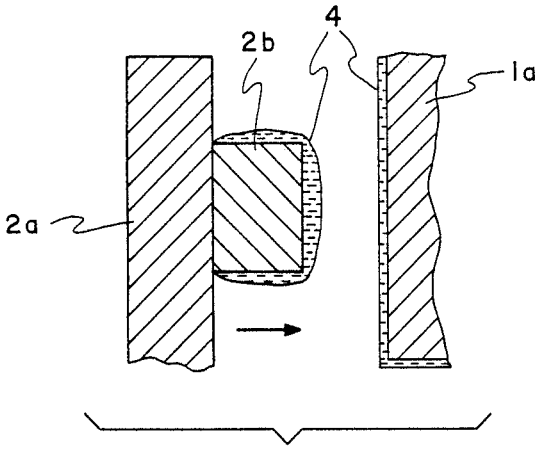
FIGS. 7A and 7B are side section views showing the state in which the movable contact shown in FIG. 6A comes into contact with the fixed side electrode.
Figure 7B:
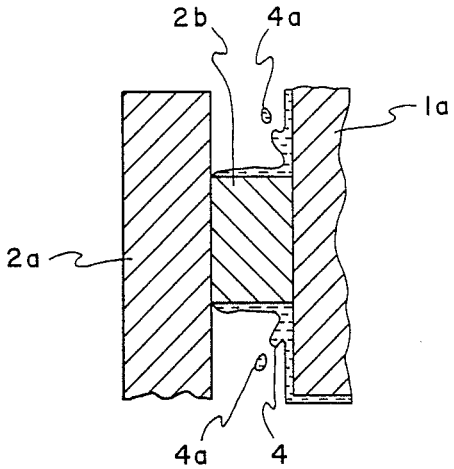

FIG. 6A shows a rectangular-shaped contact 2*b* which may be used in the embodiment of FIG. 2. In this case, because the contact face opposed to the pole section 1*a* is a large plane as shown in FIG. 7A, the mercury 4 on this contact face may be strongly forced out to the periphery of the contact face and may splash in minute droplets 4*a* as soon as the contact 2*b* collides with the pole section 1*a* (FIG. 7B). Therefore, the useful life of the switch can be further extended by preventing the splashing of such droplets 4*a*.

Figure 8A:
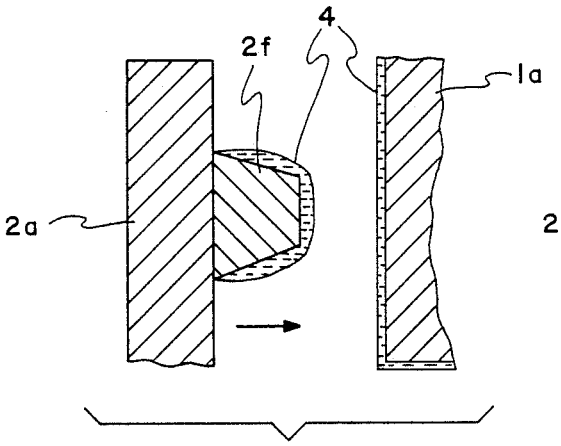
FIGS. 8A and 8B are side section views showing the state in which the movable contact shown in FIG. 6B comes into contact with the fixed side electrode.
Figure 8B:
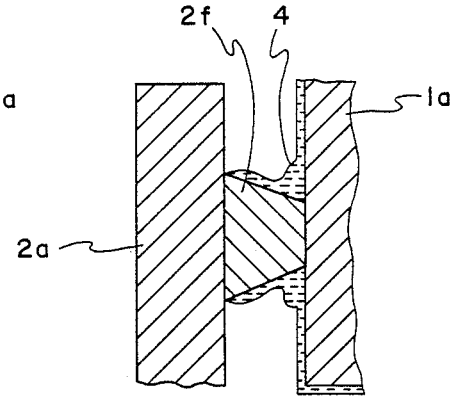

Contacts 2*f* to 2*i*, illustrated in FIGS. 6B to 6E are generally conically, hemispherically, prismoidally and semicolumnarly shaped, respectively, to make the contact face area smaller than the area where the contact is fastened to the armature 2*a* by tapering the side face of the contact and thereby preventing the splashing of mercury due to the contacting. These contact shapes, as the example of FIGS. 8A and 8B indicates, reduces the quantity of mercury which is forced out to the peripheries at the moment of the contacting impact of the pole section 1*a*. Furthermore, the forced-out mercury joins the mercury on the side face (tapered section) of the contact 2*f* and is returned, so that it is difficult for the minute droplets to occur. The splashing quantity is significantly reduced. The average operation life of the switch using the contact in any one of the shapes shown in FIGS. 6B to 6E is extended, even to the order of 500 million operations.

The materials usable for the structural elements are not restricted to those used in the above-mentioned describtion. Other alternatives and modifications to the above-mentioned embodiment can be made within the scope of the invention defined by the appended claims.

What is claimed is:

1. A mercury wetted contact switch comprising:

a sealed housing;

mercury sealed inside said housing;

a fixed contact side cylindrical electrode with a hollow area, said fixed contact being hermetically fitted through and sealed to one end of said housing and having a flat magnetic pole section formed at one end of the electrode within said housing, the magnetic pole section and the internal face of the cylindrical electrode being wettable with said mercury, and said mercury being maintained in the hollow area within said cylindrical electrode, at least one hole formed in said flat magnetic pole section reaching into the hollow area to supply the mercury to the surface of said flat magnetic pole secton;

a movable contact side electrode hermetically fitted through and sealed to the other end of said housing;

an armature which is unwettable with said mercury and which is positioned at one end of said movable contact side electrode to swing toward or away from said magnetic pole section; and a movable contact which is wettable with said mercury and fastened to said armature for coming into contact with or breaking away from said magnetic pole section, the movable contact having a selected one of a conical shape, a semispherical shape, or a prismoidal shape.

2. A mercury wetted contact switch, as claimed in claim 1 wherein a gap between a face of said armature and an inner face of said housing is smaller than a contact gap between said movable contact and said magnetic pole section.

* * * * *